US005500662A

United States Patent [19]

Watanabe

[11] Patent Number: 5,500,662

[45] Date of Patent: Mar. 19, 1996

[54] INK JET RECORDING METHOD FOR RECORDING IN PLURAL SCANS

[75] Inventor: Kenjiro Watanabe, Tokyo, Japan

[73] Assignee: Canon Kabushiki Kaisha, Tokyo, Japan

[21] Appl. No.: 29,945

[22] Filed: Mar. 9, 1993

Related U.S. Application Data

[63] Continuation of Ser. No. 689,091, Apr. 22, 1991, abandoned, which is a continuation of Ser. No. 369,861, Jun. 22, 1989, abandoned.

[30] Foreign Application Priority Data

Jun. 22, 1988 [JP] Japan ..... 63-152160

[51] Int. Cl.[6] ..... B41J 2/21; B41J 2/05

[52] U.S. Cl. ..... 347/43

[58] Field of Search ..... 346/140, 1.1; 347/43

[56] References Cited

U.S. PATENT DOCUMENTS

| | | | |
|---|---|---|---|
| 4,320,406 | 3/1982 | Heinzl | 347/43 |
| 4,403,874 | 9/1983 | Payne | 400/124 |
| 4,528,576 | 7/1985 | Koumura et al. | 347/43 |
| 4,540,996 | 9/1985 | Saito | 347/43 |
| 4,593,295 | 6/1986 | Matsufujii | 347/43 |
| 4,617,580 | 10/1986 | Miyakawa | 347/14 |
| 4,630,946 | 12/1986 | Mizutani | 400/121 |
| 4,631,548 | 12/1986 | Milbrandt | 347/43 X |
| 4,680,596 | 7/1987 | Logan | 347/43 |
| 4,712,172 | 12/1987 | Kiyohara | 347/60 |
| 4,748,453 | 5/1988 | Lin | 347/43 |
| 4,760,408 | 7/1988 | Kanayama | 347/43 |
| 4,788,563 | 11/1988 | Omo | 347/14 |
| 4,855,752 | 8/1989 | Bergstedt | 347/43 |
| 4,943,813 | 7/1990 | Palmer | 347/20 |

FOREIGN PATENT DOCUMENTS

| | | | |
|---|---|---|---|
| 55-42836 | 3/1980 | Japan . | |
| 59-182774 | 10/1984 | Japan . | |
| 60-199662 | 10/1985 | Japan | B41J 3/04 |
| 228158 | 11/1985 | Japan | B41J 3/04 |

*Primary Examiner*—Joseph W. Hartary
*Attorney, Agent, or Firm*—Fitzpatrick, Cella, Harper & Scinto

[57] ABSTRACT

An ink jet recording method for effecting polychromatic recording by the use of inks of two or more colors includes the process of repeating one-line printing with one color at a time in conformity with the number of colors used on the same line, and the forming one line of a polychromatic recorded portion. A color ink of low lightness is provided in the first one-line printing.

6 Claims, 6 Drawing Sheets

Y HEAD
M HEAD
C HEAD
Bk HEAD

FIXATION

Y HEAD
M HEAD
C HEAD
Bk HEAD

FIXATION

Y
M
C
Bk
R
G
B

INK JET RECORDING METHOD FOR RECORDING IN PLURAL SCANS

This application is a continuation of application Ser. No. 07/689,091 filed Apr. 22, 1991, abandoned, which is a continuation of application Ser. No. 07/369,861, filed Jun. 22, 1989, abandoned.

BACKGROUND OF THE INVENTION

1. Field of the Invention

This invention relates to an ink jet recording method and an apparatus used in said method, and in particular to a recording method suitable for forming good polychromatic images on plain paper or the like by the use of inks of two or more colors, and an apparatus used in said method.

2. Related Background Art

Polychromatic recording by an ink jet recording apparatus, i.e., formation of an image composed of two or more colors, has been accomplished by the use of an ink jet recording apparatus of the construction as shown, for example, in FIGS. 3A and 3B of the accompanying drawings and by causing a carriage 2 carrying the four-color recording head 1 of said apparatus to scan along sliding shafts 3, causing ink of each color to be discharged from the recording head during one scan in conformity with recording information, as shown, for example, in FIG. 4 of the accompanying drawings, and thereby expressing a single color or a mixed color portion of two colors (FIGS. 4(*b*) of the accompanying drawings).

However, with the above-described recording method, it is possible to form good images on a recording medium of high water absorbing property such as coated paper, but much time is required for the drying of recording liquid in the case of plain paper or OHP (overhead projection) paper which is low in water absorbing property and therefore, "blot" of colors arises between picture elements expressing different colors, and this has sometimes resulted in remarkable deterioration of the quality of images formed.

That is, if as shown in FIG. 4(*c*) of the accompanying drawings, inks of different colors are caused to adhere to a recording medium in a lump by one scan to thereby form one line of polychromatic record portion (record portion comprising picture elements expressing two or more different colors) mixing of inks occurs in the portion wherein ink dots overlap one another until the ink dots dry and are fixated. Such mixing of the inks, if it occurs in the boundary portion between picture elements expressing different colors (e.g. picture elements Y and M), causes the "blot or blur" of colors in the recorded image.

To suppress such "blot", the diameter of the ink dots may be made small to thereby prevent the contact between adjacent dots but this will give rise to a limit in the density of the entire recorded image, which in turn will be inconvenient for obtaining images of good contrast.

On the other hand, even in a printing method wherein as shown in FIG. 5 of the accompanying drawings, the amount of ink per picture element is made equal between the case of a mixed color portion (a portion to which inks of two or more colors are caused to adhere in one picture element) and the case of a single-colored portion (a portion to which only an ink of a single color is caused to adhere in one picture element), the occurrence of the "blot" as shown in FIG. 5(*c*) cannot be prevented on a recording medium of poor water absorbing property.

SUMMARY OF THE INVENTION

It is an object of the present invention to provide an ink jet recording method in which the occurrence of the above-described "blot" can be prevented by a simple improvement in the recording method, i.e., the improvement in the scanning system of a recording head, whereby good polychromatic image recording can be accomplished, and a recording apparatus suitably usable in such method.

In the ink jet recording method of the present invention, a polychromatic recorded portion (a recorded image portion including picture elements expressing two or more different colors) is formed by repeating one-line printing by color in conformity with at least the number of colors used on the same line, and this can be carried out, for example, by the apparatus of the present invention.

This one-line printing by color is effected with such an interval that, regarding the drying and fixation of ink dots of a first color which have previously adhered and between ink dots of a second color which subsequently adhere, mixing of these dots of different colors in the boundary portion therebetween which will cause the "blot" as described above does not occur. At least the "blot" does not appear so remarkably as to deteriorate the quality of image.

DESCRIPTION OF THE PREFERRED EMBODIMENTS

Figure 3A:
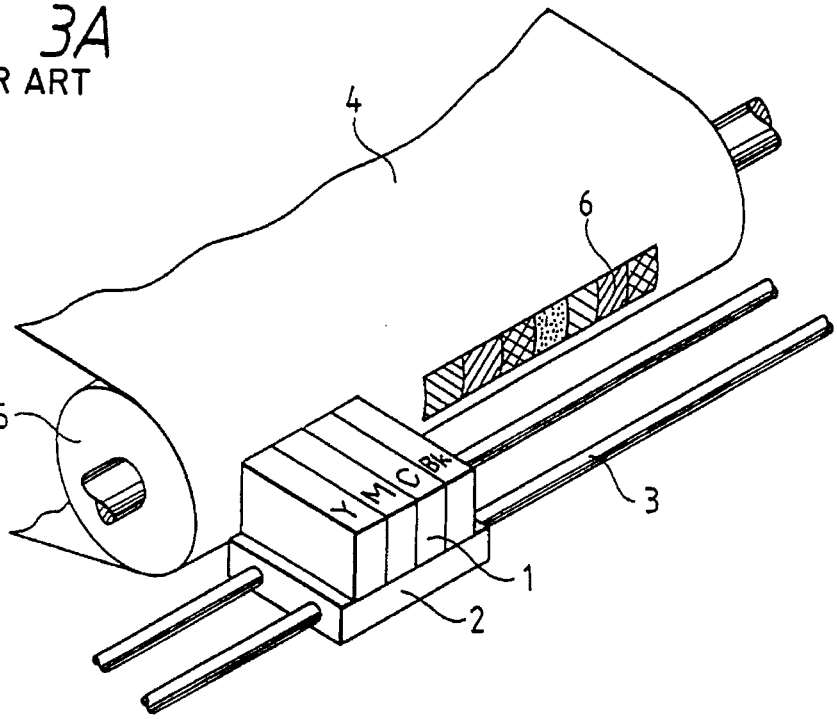
FIG. 3A PRIOR ART
FIG. 3A and 3B are schematic views showing the essential portions of an ink jet recording apparatus applied to the recording method of the present invention.
Figure 3B:
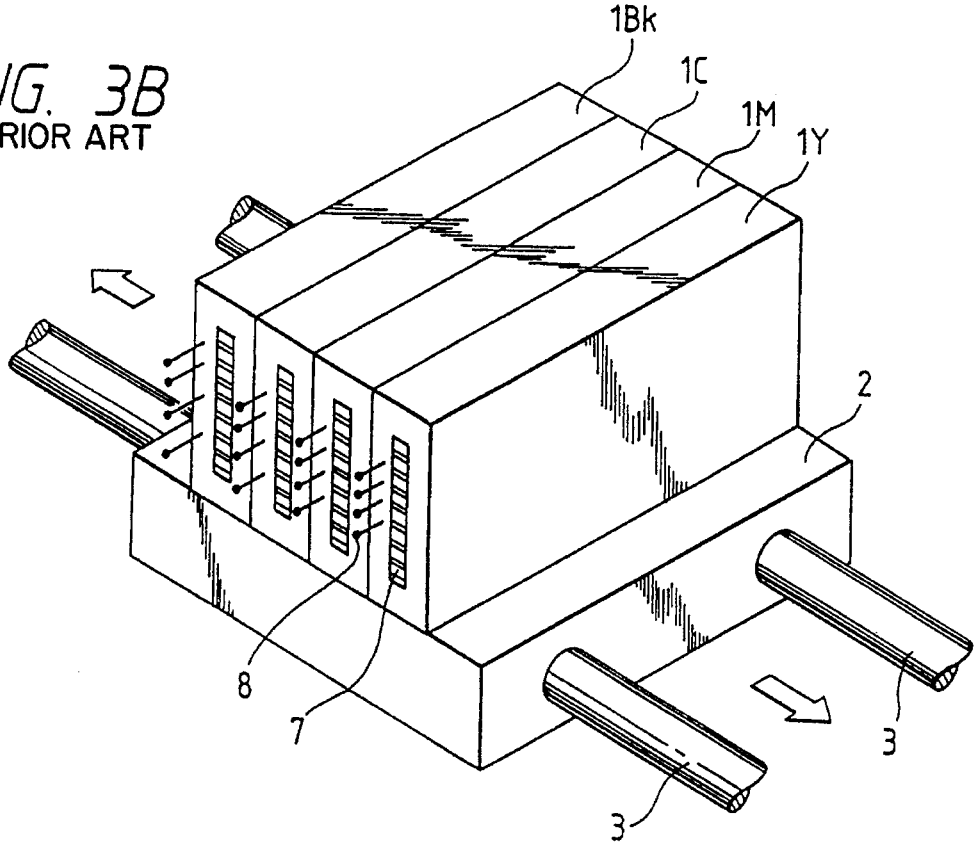
FIG. 3B PRIOR ART
Figures 4A, 4B, 4C:
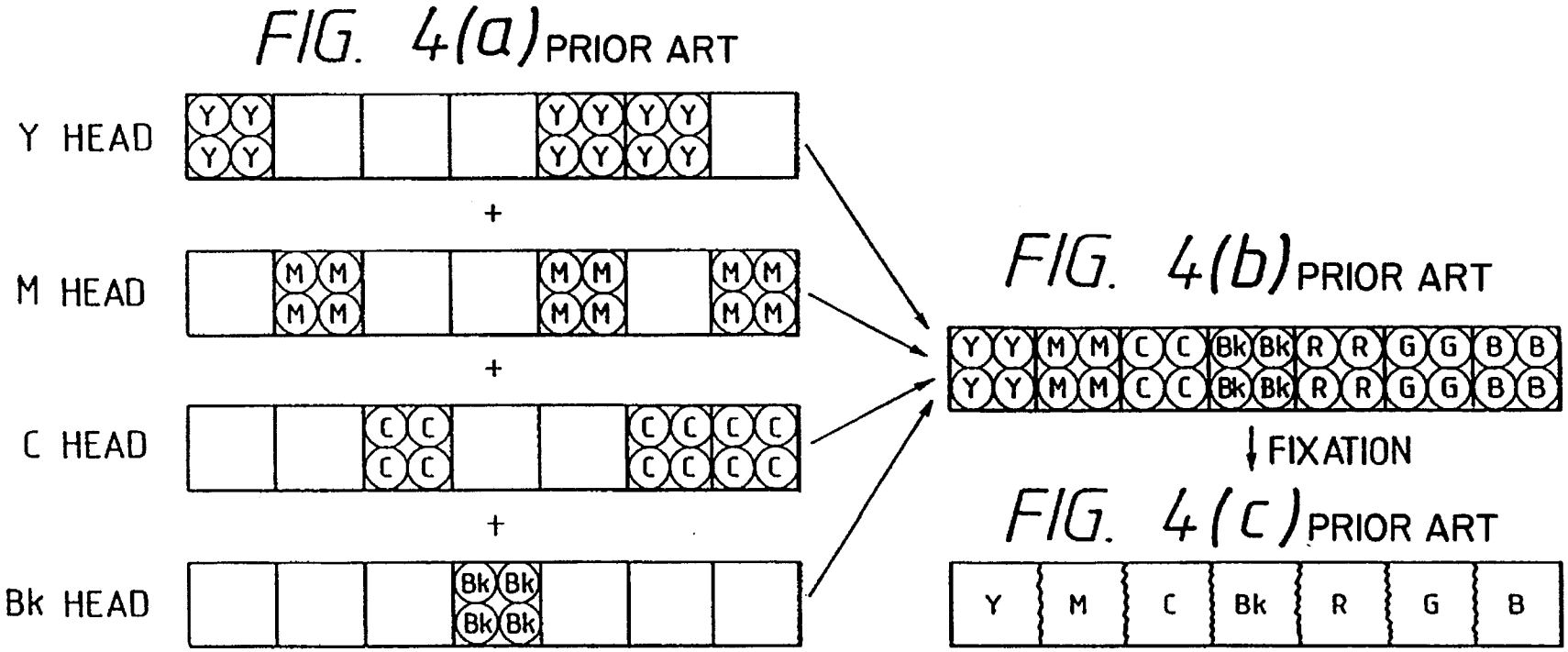
FIG. 4(a) PRIOR ART
FIG. 4(b) PRIOR ART
FIG. 4(c) PRIOR ART
FIGS. 4(*a*)–(*c*) and 5(*a*)–(*c*) are dot construction diagrams showing a recording method according to the prior art.
Figures 5A, 5B, 5C:
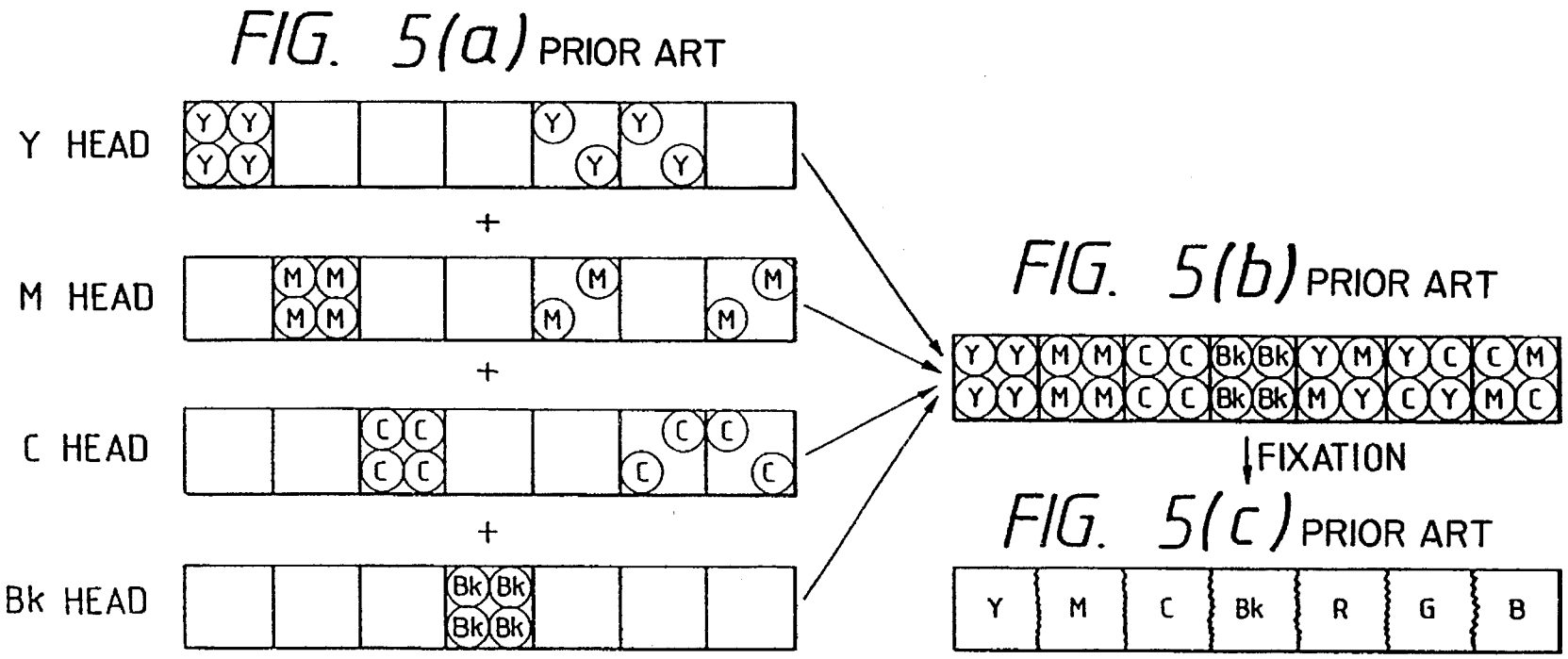
FIG. 5(a) PRIOR ART
FIG. 5(b) PRIOR ART
FIG. 5(c) PRIOR ART

The ink jet recording method of the present invention can be carried out by an ink jet recording apparatus of the construction as shown, for example, in FIGS. 3A and 3B.

That is, this apparatus has a construction in which a recording head 1 in which recording head units corresponding to four colors, i.e., yellow (Y), magenta (M), cyan (C) and black (BK), are compounded is carried on a head carriage 2, and the carriage 2 is scanned along sliding shafts 3 by a carriage driving motor, not shown, whereby a polychromatic recorded image can be formed on recording paper (a recording medium) 4.

FIG. 3B shows the essential portions of the recording head 1 shown in FIG. 3A, and each head unit has a plurality of discharge ports 7 through which flying droplets of ink 8 are discharged toward the recording paper 4.

The kinds of ink (the number of colors) and the number of recording heads for respective colors are not limited to four, but may be suitably changed as desired.

Figure 1:
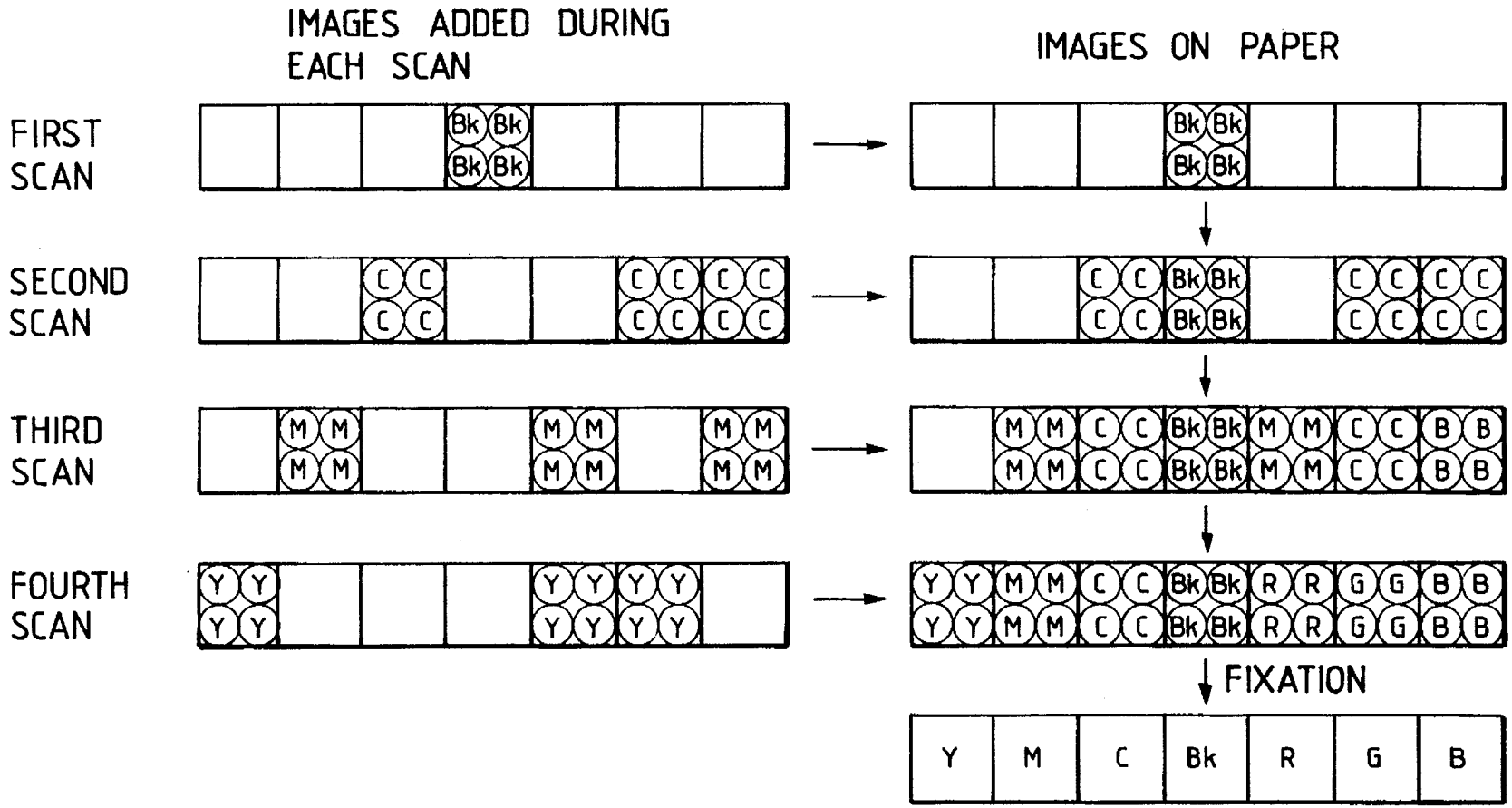
FIG. 1 is a dot construction diagram showing an embodiment of the recording method of the present invention.

An embodiment of the recording method of the present invention is shown in FIG. 1. According to this method, the same amount of ink of one color adheres to each picture element constituting one line of a polychromatic record portion. Thus, an amount of ink twice as great as the ink adhering to a picture element to which only ink of one color adheres to a picture element to which inks of two colors adhere.

In this method, printing by only the black (BK) head is first effected in conformity with recording information during the first scan of the recording head, and only BK dots are printed on the recording medium. That is, the first scan scans an ink having a color of low lightness, such as black (BK).

Subsequently, during the second scan, printing by only the cyan (C) head is effected in conformity with the recording information, and C dots are printed on the recording medium one position deviated from the dot position of ink of the color of low lightness.

Further, during the third scan, the magenta (M) head is scanned and during the fourth scan, the yellow (Y) head is scanned, whereby M dots and Y dots are printed in the named order in conformity with the recording information.

The intervals between the above-described printing scans by color are set to such a degree that mixing of the inks in the boundary portion, or border, between the dots of the color printed earlier and the dots of the color printed later hardly occurs. As a result, for example, in the boundary between the cyan and the black printed by the first scan and the second scan, respectively, C dots adjacent to the BK dots printed earlier are printed in a state in which the drying and fixation of the BK dots have progressed to a certain degree, whereby it is difficult for undried inks to mix together and therefore, it is difficult for the "blot" as previously described to occur in the boundary area between the picture element C expressing cyan and the picture element BK expressing black.

One scan in the printing scan by color may be effected by the reciprocal scanning of the recording head on the recording medium or by only the forward scanning or the backward scanning in the reciprocal scanning of the recording head.

Also, the case where printing of four colors is effected in one line is shown in FIG. 1, but depending on the recording information, there is a case where a print of only two or three colors is included in one line and therefore, in such a case, the number of scans required for one line may be adjusted to two or three, and if printing is effected while the number of scans is adjusted by a judgment being formed each time, the throughput can also be made quick. When the number of colors to be printed on a line is N, then N scans are required.

Further, tile order of colors printed is not restricted to the above-described example, but it is desirable to suitably choose tile order in which efficient drying and fixation of the dots printed earlier can progress between the printing scans by color.

In the method shown in FIG. 1, for example, in the case of a mixed color portion by two colors or a picture element portion expressing one color by inks of two colors, such as the picture element B, the amount of ink in one picture element is twice that in a single color portion or a picture element portion expressing one color by an ink of one color, such as the picture element Y, and when use is made of a recording medium which is so poor in water absorbing property that a longer time is required for drying and fixation, the intervals between the printing scans by color must be made longer.

Figure 2:
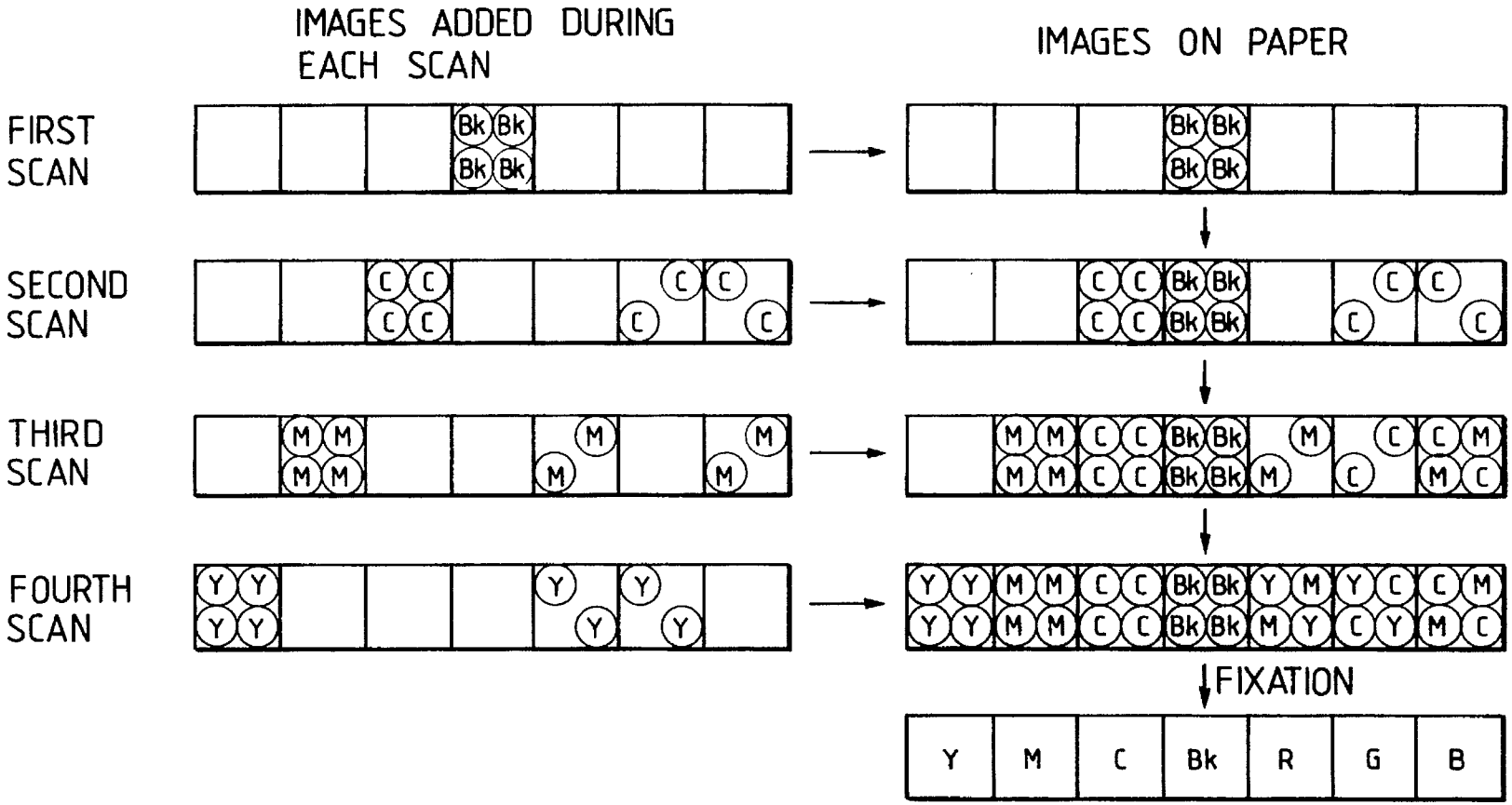
FIG. 2 is a dot construction diagram showing another embodiment of the recording method of the present invention.

So, when such a recording medium is used, the mixed color portion of two colors is formed by a ½-thinned pattern as shown in FIG. 2. That is, printing is effected with the amounts of inks of two colors adhering to the recording medium being rendered into ½ each, whereby the total amounts of adhering inks can be made equal between the mixed color portion and the single color portion and thus, the extension of the intervals between the printing scans by color can be avoided. When a mixed color portion of three colors is to be formed, the amounts of inks of the three colors adhering to the recording medium may likewise be rendered into ⅓ each. When a mixed color portion of N colors is to be formed, an amount of ink equal to 1/N the normal amount is used for each ink color.

According to the present invention, a polychromatic recorded portion is formed by the repetition of the printing scans by color effected at suitable intervals and therefore, the occurrence of "blot" in the boundary area between picture elements expressing different colors is prevented and polychromatic images of good quality can be easily formed even on a recording medium such as plain paper which is low in water absorbing property and requires a relatively long time for drying and fixation of recorded images.

Moreover, the present invention can be achieved by a very simple and low-cost means, namely, a change in the control program of the ink jet recording apparatus such as a change in the carriage scanning method and discharge timing.

Also, when one line has been printed in full colors, recording paper becomes swollen due to the great amount of ink and "swelling" often occurs. Thus, it has been necessary to secure a certain degree of distance between the recording medium and the recording head. However, in the printing scan by color according to the present invention, the amount of ink printed during one scan is small and the ink printed is dried each time printing is effected and therefore, it is difficult for the swelling of the recording paper to occur and the distance between the recording medium and the recording head can be set to a small value. Therefore, good images having very little printing twist can be obtained.

The present invention may be used particularly for the back print mode which is the back print forming mode in which the above-noted problem arises and in which a mirror image is formed on the back of back printing paper (paper having an ink absorbing layer provided on the back of the resin surface thereof) and a positive image is seen from the resin surface side, and may also be used only in the photographic mode in which the quality of image need be made good. In addition, the present invention is particularly effective in the dark original mode in which an original high in its density which can be discriminated by an operation or automatically is read by a copying machine and is recorded by ink jet, and the present invention is more effective in a mode in which the amount of information is controlled by error the diffusing method and then the present invention is carried out. The above-described embodiment is most preferable as an embodiment in which the present invention is also used in other heads than the black head, but the present invention is sufficiently effective even if only the control of the amount of information of the black head is adopted as a countermeasure for black streaks.

The present invention brings about an excellent effect particularly in a recording head or a recording apparatus of the bubble jet type among the ink jet recording systems.

As regards the typical construction and principle of such system, it is preferable to use the basic principles disclosed, for example, in U.S. Pat. No. 4,723,129 and U.S. Pat. No. 4,740,796. This system is applicable to both the so-called on-demand type and the so-called continuous type. Particularly in the case of the on-demand type, at least one driving signal corresponding to recording information and providing a rapid temperature rise exceeding the nuclear boiling is applied to an electro-thermal converting member disposed correspondingly to a sheet or a liquid path in which liquid (ink) is retained, whereby heat energy is generated in the electro-thermal converting member and film boiling is generated on the heat-acting surface of the recording head with a result that a bubble in the liquid (ink) corresponding to the driving signal at one to one can be formed, and is effective. The liquid (ink) is discharged by the growth and contraction of this bubble through a discharge opening and at least one droplet is formed thereby. If this driving signal is pulse-shaped, the growth and contraction of the bubble take place appropriately on the spot and therefore, liquid (ink) discharge particularly excellent in responsiveness can be accomplished, and this is more preferable. This pulse-shaped driving signal may suitably be one as described in U.S. Pat. No. 4,463,359 or U.S. Pat. No. 4,345,262. If the conditions described in U.S. Pat. No. 4,313,124 regarding the rate of temperature rise of said heat-acting surface are adopted, more excellent recording can be accomplished.

As the construction of the recording head, besides the combination of a discharge port, a liquid path and an electro-thermal converting member as disclosed in the aforementioned U.S. Patents (a rectilinear liquid flow path or a perpendicular liquid flow path), the constructions using U.S. Pat. No. 4,558,333 and U.S. Pat. No. 4,459,600 which disclose constructions in which the heat-acting portion is disposed in a bent area are also covered by the present invention. In addition, the present invention is also effective if use is made of the construction based on Japanese Laid-Open Patent Application No. 59-123670 which discloses a construction in which a slit common to a plurality of electro-thermal converting members is used as the discharge portion of the electro-thermal converting members, or Japanese Laid-Open Patent Application No. 59-138461 which discloses a construction in which an opening for absorbing the pressure wave of heat energy is made to correspond to a discharge portion.

Further, the full line type recording head having a length corresponding to the maximum width of a recording medium on which recording can be effected by a recording apparatus may be of a construction which satisfies that length by a combination of a plurality of recording heads as disclosed in the aforementioned Laid-Open Patent Applications or a construction as a single recording head formed as a unit, and the present invention can display the above-noted effect more effectively. In addition, the present invention is also effective for a case where use is made of an interchangeable chip type recording head which is mounted on an apparatus body, whereby electrical connection with the apparatus body and supply of ink from the apparatus body become possible, or a cartridge type recording head which is integrally provided in a recording head itself.

Also, it can make the effect of the present invention more stable to add to the present invention recovery means, preliminary auxiliary means, etc. for the recording head which are provided as the construction of the recording apparatus, and this is preferable. More specifically, it is also effective for accomplishing stable recording to provide capping means, cleaning means, pressurizing or suction means, and preliminary heating means comprising an electro-thermal converting member or a heating element discrete therefrom or a combination thereof for the recording head, and carry out the preliminary discharge mode in which discharge discrete from recording is effected. Further, the recording mode of the recording apparatus is not limited to the recording mode of only the main color such as black, but may also be a mode provided by a recording head constructed as a unit or a combination of a plurality of recording heads, and the present invention is also very effective for an apparatus provided with at least one of a plurality of different colors or full colors by mixed colors.

In the case of plain paper, the amount of blur becomes great and therefore, in a recording mode using plain paper, it is preferable to adopt a control mode prescribed in advance so as to carry out the present invention.

Figure 6:
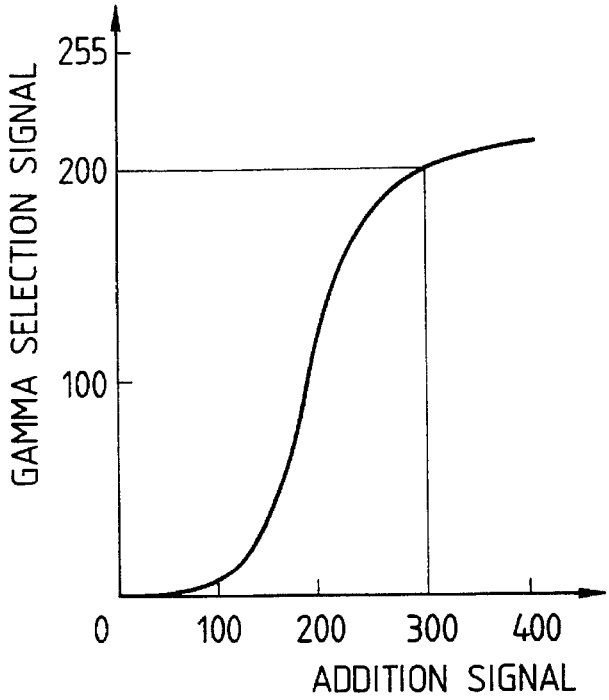
FIG. 6 is a graph for explaining a relationship between the addition signal and a gamma selection signal.
Figure 7:
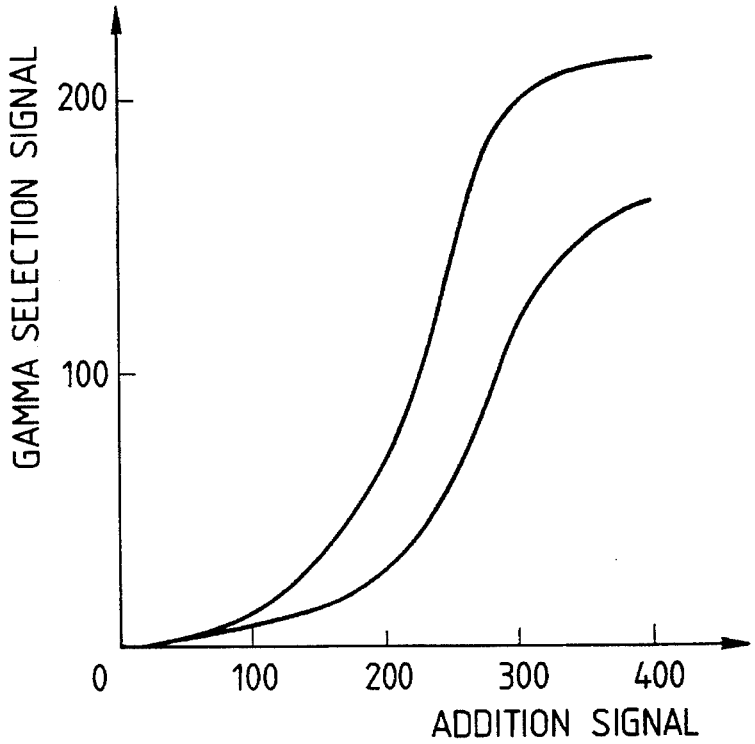
FIG. 7 is a view showing a relationship between an addition signal and a correction coefficient.

In any case, in the present invention, the sum of image data is calculated and only when the value thereof exceeds a data value for which the amount of blur is great, that data amount is subtracted, preferably on the basis of the correction means of the apparatus body predetermined on the basis of a subtraction formula as indicated by a gamma curve as shown in FIGS. 6 and 7 is used as the data for actually effecting recording and therefore, recording of good quality free of black streaks, white streaks, density irregularity and color irregularity can be accomplished.

I claim:

1. A method for recording a color image on a recording medium, using a recording apparatus which performs a main scan by relatively moving recording means with respect to the recording medium, the recording means having a plurality of recording sections, each discharging ink of different colors, said method comprising the steps of:

performing a first main scan for recording an image of a first color on a predetermined area of the recording medium by utilizing a first recording section for discharging ink of the first color, recording sections other than said first recording section among said plurality of recording sections not being driven during the first main scan;

performing, after termination of the first main scan, a second main scan for recording an image of a second color on the predetermined area of the recording medium by utilizing a second recording section, recording sections other than said second recording section among said plurality of recording sections not being driven during the second main scan; and performing, after termination of the second main scan, a third main scan for recording an image of a third color on the predetermined area of the recording medium by utilizing a third recording section, recording sections other than said third recording section among said plurality of recording sections not being driven during the third main scan, wherein a lightness of the first color is lower than a lightness of the second color and the lightness of the second color is lower than a lightness of the third color.

2. A method according to claim 1, wherein the first, second and third main scans are performed at a predetermined time interval and the interval is set so that ink is not mixed at borders of dots of colors different from each other.

3. A method according to claim 1, wherein a mixed-color area of the second and third colors is recorded with the ink of the second color in a predetermined intermittent pattern during the second main scan and the mixed-color area is recorded with the ink of the third color in a complementary intermittent pattern during the third main scan.

4. A method according to claim 1, wherein the recording sections are arranged in a direction of the main scans.

5. A method according to claim 1, wherein each recording section includes a plurality of discharge energy generating elements for discharging ink.

6. A method according to claim 5, wherein each discharge energy generating element generates thermal energy and a bubble is formed in ink by utilizing the thermal energy to effect a state change in the ink so that an ink droplet is discharged from a discharge port.

* * * * *